US010475404B2

(12) United States Patent
An

(10) Patent No.: US 10,475,404 B2
(45) Date of Patent: Nov. 12, 2019

(54) DRIVING METHOD OF SCAN LINES IN DISPLAY PANEL AND DRIVING DEVICE THEREOF

(71) Applicant: SHENZHEN CHINA STAR OPTOELECTRONICS TECHNOLOGY CO., LTD., Guangdong (CN)

(72) Inventor: Liyang An, Guangdong (CN)

(73) Assignee: SHENZHEN CHINA STAR OPTOELECTRONICS TECHNOLOGY CO., LTD, Guangdong (CN)

( * ) Notice: Subject to any disclaimer, the term of this patent is extended or adjusted under 35 U.S.C. 154(b) by 130 days.

(21) Appl. No.: 15/327,386

(22) PCT Filed: Jan. 6, 2017

(86) PCT No.: PCT/CN2017/070463
§ 371 (c)(1),
(2) Date: Jan. 19, 2017

(87) PCT Pub. No.: WO2018/120285
PCT Pub. Date: Jul. 5, 2018

(65) Prior Publication Data

US 2018/0182326 A1 Jun. 28, 2018

(30) Foreign Application Priority Data

Dec. 27, 2016 (CN) ..... 2016 1 1225583

(51) Int. Cl.
*G09G 3/36* (2006.01)

(52) U.S. Cl.
CPC ..... *G09G 3/3614* (2013.01); *G09G 3/3622* (2013.01); *G09G 3/3648* (2013.01); *G09G 2310/0283* (2013.01); *G09G 2320/0209* (2013.01)

(58) Field of Classification Search
CPC .. G09G 3/3614; G09G 3/3648; G09G 3/3622; G09G 2320/0209; G09G 2310/0283
See application file for complete search history.

(56) References Cited

U.S. PATENT DOCUMENTS 7,102,603 B2 * 9/2006 Kondoh ..... G09G 3/3633 345/87
9,686,533 B2 * 6/2017 Li ..... G09G 3/20
9,697,782 B2 * 7/2017 Liu ..... G09G 3/3614
9,704,437 B2 7/2017 Cao et al.
(Continued)

FOREIGN PATENT DOCUMENTS

CN 1229477 A 9/1999
CN 103035213 A 4/2013
(Continued)

*Primary Examiner* — Vinh T Lam
(74) *Attorney, Agent, or Firm* — Mark M. Friedman

(57) ABSTRACT

A driving method of scan lines in a display panel and a driving device thereof are described. The driving method of scan lines includes the steps of dividing a plurality of frames into a first frame set and a second frame set, and turning on the scan lines of each frame in the first frame set by using a forward scan direction and turning on the scan lines in the second frame set by a backward scan direction.

14 Claims, 5 Drawing Sheets

(56) References Cited

U.S. PATENT DOCUMENTS

| | | | | |
|---|---|---|---|---|
| 9,706,196 | B2 | 7/2017 | Ahn et al. | |
| 2003/0034944 | A1* | 2/2003 | Kondoh | G09G 3/3633 345/87 |
| 2009/0256833 | A1* | 10/2009 | Huang | G09G 3/20 345/213 |
| 2015/0130864 | A1* | 5/2015 | Ahn | G09G 3/003 345/691 |
| 2015/0356936 | A1* | 12/2015 | Tanaka | G09G 3/36 345/209 |
| 2016/0322012 | A1* | 11/2016 | Oh | G09G 3/3648 |
| 2017/0323594 | A1 | 11/2017 | Huang et al. | |
| 2018/0151138 | A1* | 5/2018 | Jinta | G09G 3/20 |

FOREIGN PATENT DOCUMENTS

| | | | |
|---|---|---|---|
| CN | 104410854 | A | 3/2015 |
| CN | 104505033 | A | 4/2015 |
| CN | 105093602 | A | 11/2015 |
| CN | 105957868 | A | 9/2016 |

* cited by examiner

DRIVING METHOD OF SCAN LINES IN DISPLAY PANEL AND DRIVING DEVICE THEREOF

BACKGROUND OF THE INVENTION

Field of Invention

The present invention relates to a technical field a display, and more particularly to a driving method of scan lines in a display panel (e.g., a liquid crystal display) and a driving device thereof.

Description of Prior Art

With the rapid development of a thin film transistor (TFT) LCD, people require more and more the display quality of LCD products. A crosstalk effect is a common dysfunctional phenomenon of the TFT-LCD. People usually define the crosstalk effect as an influence of another region on one region in a whole display screen of the TFT-LCD, resulting in one kind of abnormalities with respect to frame distortions.

The crosstalk effect often needs to be seen in specific frame. For an example of a white display block displayed on a center region in a grey level background, the upper region of the white display block becomes bright and the bottom region of the white display block becomes dark. Furthermore, because more and more frames are gradually displayed and each of the frames results in the same crosstalk effect, the display quality of the display panel is severely affected.

Consequently, there is a need to develop a driving method of scan lines in an LCD panel and a driving device thereof to solve the above-mentioned problems.

SUMMARY OF THE INVENTION

Therefore, one objective of the present invention is to provide a driving method of scan lines in a display panel and a driving device thereof to solve the problem of display abnormalities of the display panel due to a crosstalk effect resulting in a severe affection on the display quality of the display panel.

Based on the above objective, the present invention sets forth the following technical solutions. The present invention provides a driving method of scan lines in a display panel, wherein the display panel comprises a plurality of scan lines, a plurality of data lines, and a plurality of pixel units defined by interlacing the scan lines with the data lines. The driving method includes the steps of dividing a plurality of adjacent frames into a first frame set and a second frame set; and turning on the scan lines of each frame in the first frame set by using a forward scan direction and turning on the scan lines in the second frame set by a backward scan direction; wherein a plurality of polarities corresponding to a plurality of pixel units in the adjacent frames are inversed, and the polarities corresponding to the pixel units in a same column are identical.

In the driving method of scan lines in the display panel, the adjacent frames are divided into a plurality of different frame sets respectively.

In the driving method of scan lines in the display panel, the frames in a same frame set are a plurality of continuous frames.

In the driving method of scan lines in the display panel, a number of the frames in the first frame set is equal to a number of the frames in the second frame set.

In the driving method of scan lines in the display panel, a number of the frames in the first frame set is unequal to a number of the frames in the second frame set.

In the driving method of scan lines in the display panel, a the polarities corresponding to the pixel units in a plurality of adjacent columns are inversed.

The present invention further provides a driving method of scan lines in a display panel, wherein the display panel comprises a plurality of scan lines, a plurality of data lines, and a plurality of pixel units defined by interlacing the scan lines with the data lines. The driving method includes the steps of dividing a plurality of adjacent frames into a first frame set and a second frame set; and turning on the scan lines of each frame in the first frame set by using a forward scan direction and turning on the scan lines in the second frame set by a backward scan direction.

In the driving method of scan lines in the display panel, the adjacent frames are divided into a plurality of different frame sets respectively.

In the driving method of scan lines in the display panel, the frames in a same frame set are a plurality of continuous frames.

In the driving method of scan lines in the display panel, a number of the frames in the first frame set is equal to a number of the frames in the second frame set.

In the driving method of scan lines in the display panel, a number of the frames in the first frame set is unequal to a number of the frames in the second frame set.

In the driving method of scan lines in the display panel, a plurality of polarities corresponding to a plurality of pixel units in the adjacent frames are inversed.

In the driving method of scan lines in the display panel, the polarities corresponding to the pixel units in a same column are identical.

In the driving method of scan lines in the display panel, the polarities corresponding to the pixel units in a plurality of adjacent columns are inversed.

The present invention still further provides a driving device of scan lines in a display panel, wherein the display panel comprises a plurality of scan lines, a plurality of data lines, and a plurality of pixel units defined by interlacing the scan lines with the data lines, and wherein the driving device is configured to divide a plurality of adjacent frames into a first frame set and a second frame set, and the driving device is configured to turn on the scan lines of each frame in the first frame set by using a forward scan direction and to turn on the scan lines in the second frame set by a backward scan direction.

In the driving device of scan lines in the display panel, a plurality of polarities corresponding to a plurality of pixel units in the adjacent frames are inversed.

In the driving device of scan lines in the display panel, the adjacent frames are divided into a plurality of different frame sets respectively.

In the driving device of scan lines in the display panel, the frames in a same frame set are a plurality of continuous frames.

In the driving device of scan lines in the display panel, a number of the frames in the first frame set is equal to a number of the frames in the second frame set.

In the driving device of scan lines in the display panel, a number of the frames in the first frame set is unequal to a number of the frames in the second frame set.

The driving method of scan lines in a display panel and a driving device thereof in the present invention divides the adjacent frames into first frame set and a second frame set, where the scan lines of each frame in the first frame set turn on by using the forward scan direction and the scan lines in the second frame set turn on by the backward scan direction so that the crosstalk effects on each frame of the first frame set and each frame of the second frame set can be canceled and improved to increase the display quality of the display panel.

DETAILED DESCRIPTION OF THE PREFERRED EMBODIMENTS

Figure 1:
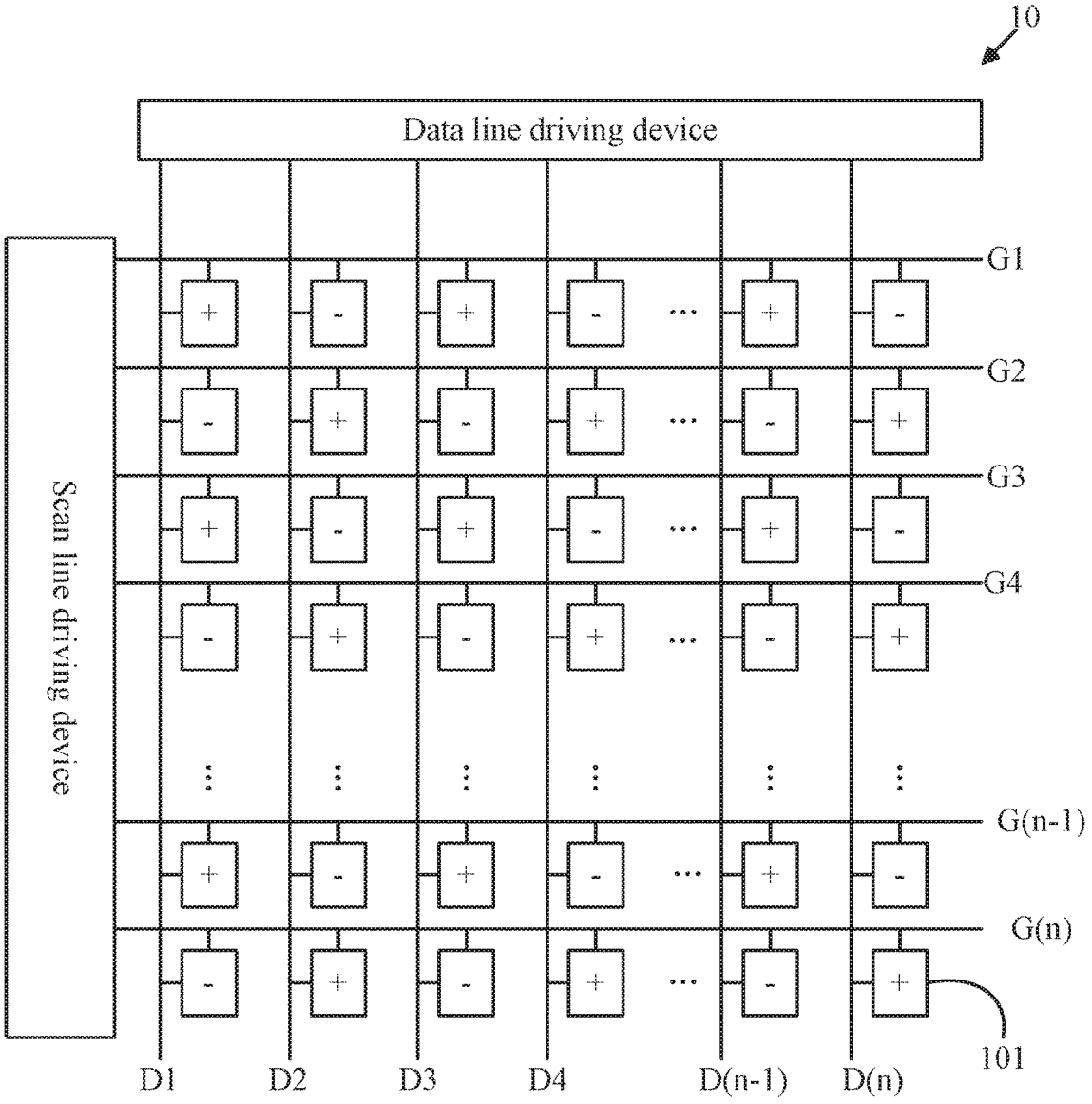
FIG. 1 is an illustrative structural view of a display panel structure of the driving method of scan lines in the display panel according to one preferred embodiment of the present invention.

The following embodiments refer to the accompanying drawings for exemplifying specific implementable embodiments of the present invention. Furthermore, directional terms described by the present invention, such as upper, lower, front, back, left, right, inner, outer, side, etc., are only directions by referring to the accompanying drawings, and thus the used directional terms are used to describe and understand the present invention, but the present invention is not limited thereto. In the drawings, the same reference symbol represents the same or a similar component.

FIG. 1 is an illustrative structural view of a display panel structure of the driving method of scan lines in the display panel according to one preferred embodiment of the present invention. The display panel 10 includes a plurality of parallel scan lines G1, G2, G3, G4, . . . , G(n−1), and G(n), and a plurality of parallel data lines D1, D2, D3, D4, . . . , D(n−1), and D(n). The scan lines G1, G2, G3, G4, . . . , G(n−1), and G(n), and the data lines D1, D2, D3, D4, . . . , D(n−1), and D(n) are interlaced to form a plurality of pixel unit 101. When the display panel 10 is operated, a plurality of adjacent frames are divided into a first frame set and a second frame set. The scan lines of each frame in the first frame set are turned on at a forward scan direction and the scan lines of each frame in the second frame set are turned on at a backward scan direction.

Figure 2:
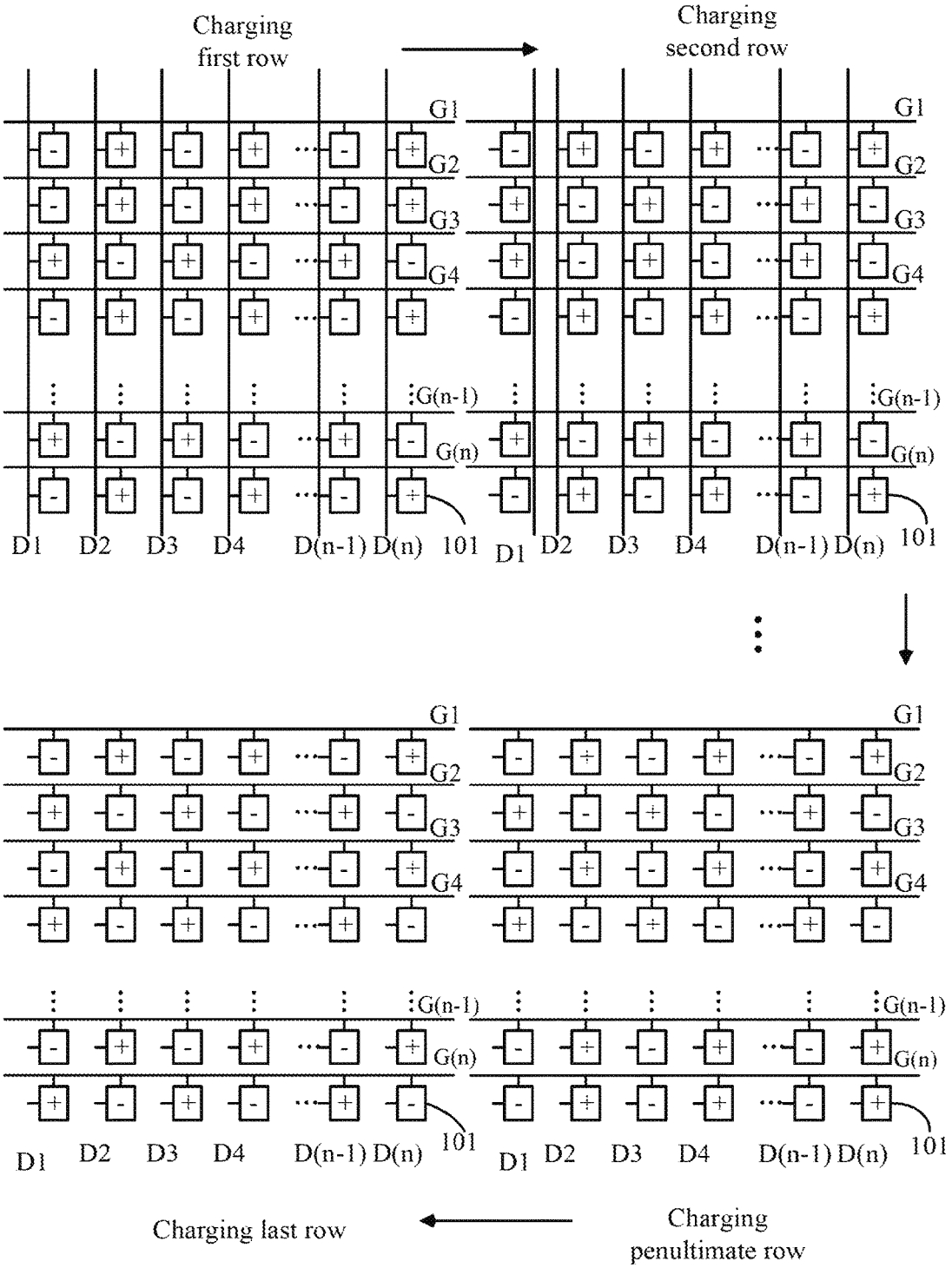
FIG. 2 is an illustrative view of charging a plurality of pixels at a forward scan direction of the driving method of scan lines in the display panel according to one preferred embodiment of the present invention.
Figure 3:
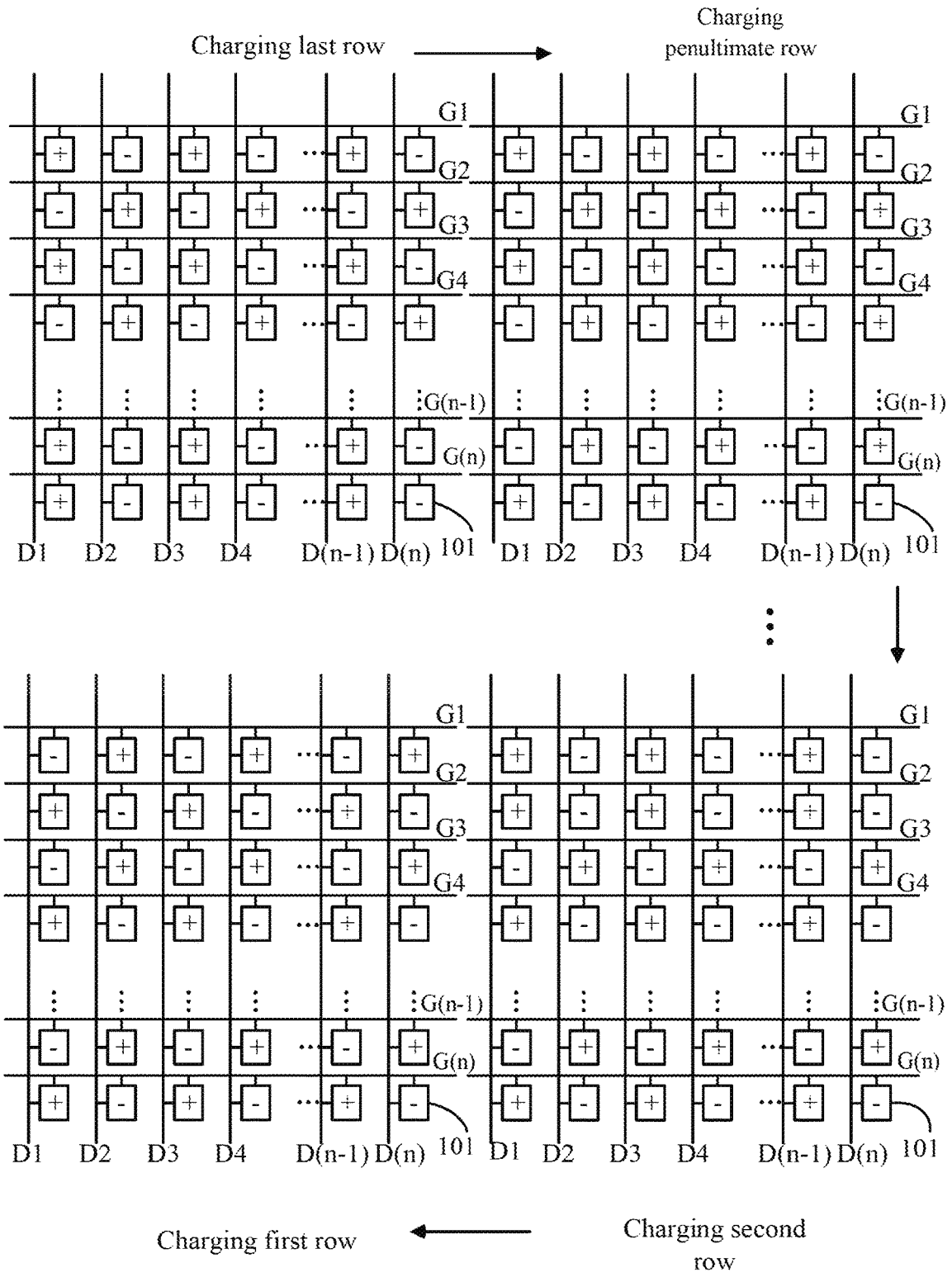
FIG. 3 is an illustrative view of charging the pixels at a backward scan direction of the driving method of scan lines in the display panel according to one preferred embodiment of the present invention.

FIG. 2 is an illustrative view of charging a plurality of pixels 101 at a forward scan direction of the driving method of scan lines in the display panel 10 according to one preferred embodiment of the present invention. FIG. 3 is an illustrative view of charging the pixels at a backward scan direction of the driving method of scan lines in the display panel according to one preferred embodiment of the present invention.

In FIG. 1, the signs "+" and "−" indicate the polarities of each pixel unit 101 of the display panel when the display panel displays a frame. As shown in FIG. 1, the scan lines G1, G2, G3, G4, . . . , G(n−1), and G(n) are arranged along a horizontal direction from the top to the bottom, and the data lines D1, D2, D3, D4, . . . , D(n−1), and D(n) are arranged along a vertical direction from the left to the right. In a same frame, the polarities of pixel units in the same column are identical, and the polarities of pixel units in the adjacent columns are inversed.

By combining with FIG. 2, when each of the pixel units 101 in FIG. 1 is charged completely, the polarity of each pixel unit 101 is depicted in FIG. 1. After the pixel units 101 in one frame are charged completely, the following frame is then charged. First, when the scan line G1 in the first row turns on, the pixel units 101 connected to the scan line G1 are charged by the data lines D1, D2, D3, D4, . . . , D(n−1), and D(n). When the scan line G2 in the second row turns on, the pixel units 101 connected to the scan line G2 are then charged by the data lines D1, D2, D3, D4, . . . , D(n−1), and D(n). The above procedure is repeated until the last scan line G(n) turns on, the pixel units 101 connected to the scan line G(n) are then charged by the data lines D1, D2, D3, D4, . . . , D(n−1), and D(n). By a forward scan direction, the scan lines G1, G2, G3, G4, . . . , G(n−1), and G(n) of the display panel 10 turn on from the top to the bottom. As shown in FIG. 1 and FIG. 2, the polarities of the corresponding pixel units 101 in the adjacent frames are inversed.

Furthermore, by combining with FIG. 3, when each of the pixel units 101 in FIG. 1 is charged completely, the following frame is then charged. First, when the scan line G(n) in the last row turns on, the pixel units 101 connected to the scan line G(n) are charged by the data lines D1, D2, D3, D4, . . . , D(n−1), and D(n). When the scan line G(n−1) in the penultimate row turns on, the pixel units 101 connected to the scan line G(n−1) are then charged by the data lines D1, D2, D3, D4, . . . , D(n−1), and D(n). The above procedure is repeated until the first scan line G1 turns on, the pixel units 101 connected to the scan line G1 are then charged by the data lines D1, D2, D3, D4, . . . , D(n−1), and D(n). By a backward scan direction, the scan lines G1, G2, G3, G4, . . . , G(n−1), and G(n) of the display panel 10 turn on from the bottom to the top to complete charge each pixel unit 101.

Figure 4:
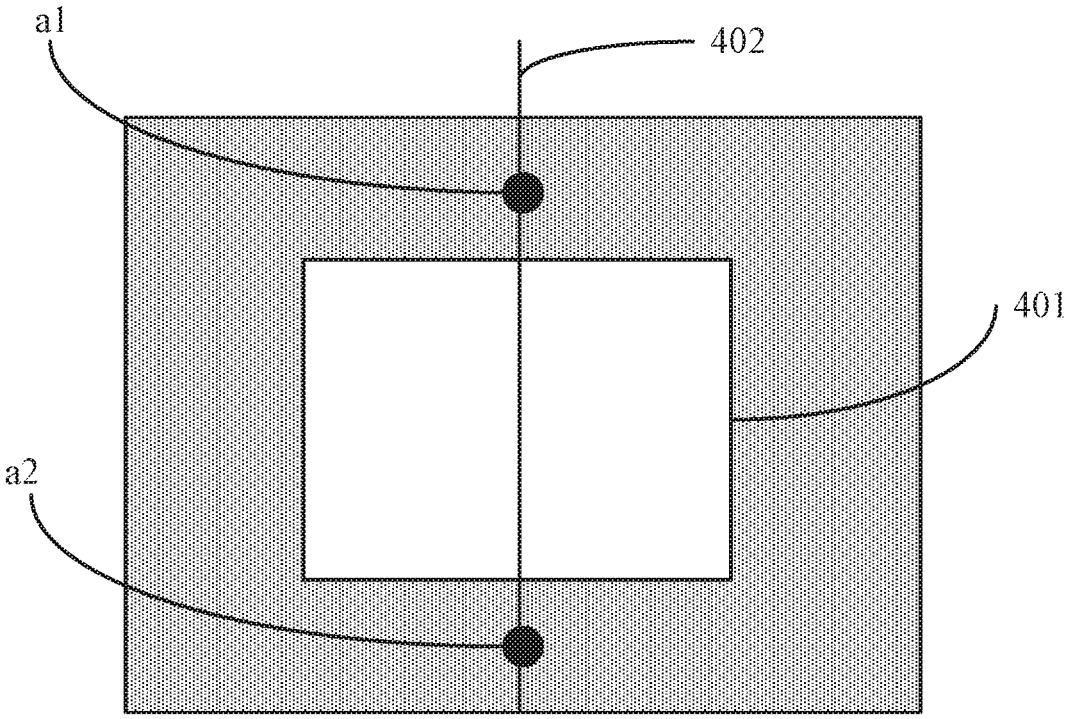
FIG. 4 is an illustrative view of a frame of the driving method of scan lines in the display panel according to one preferred embodiment of the present invention.
Figure 5:
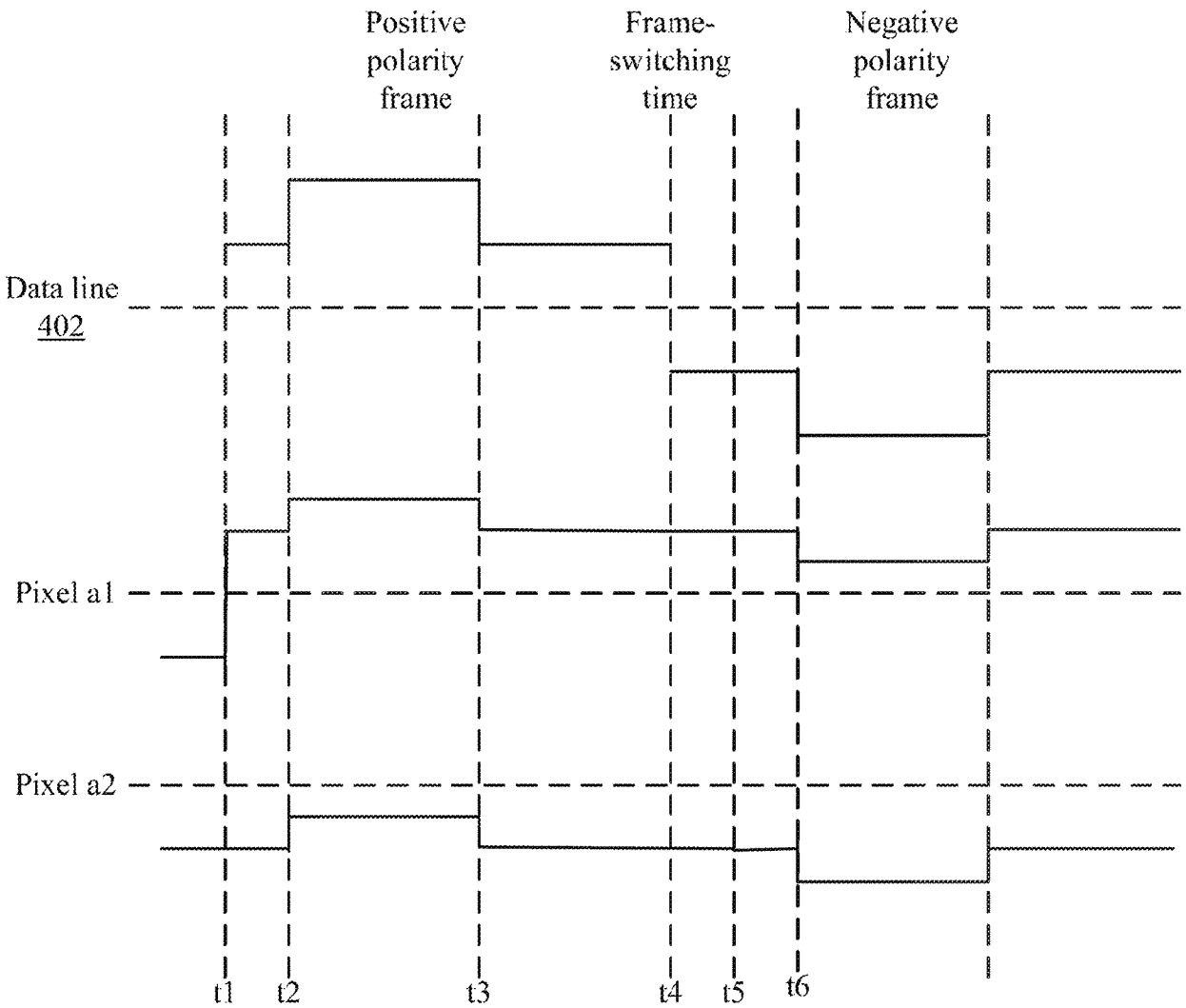
FIG. 5 is an illustrative view of a voltage waveform corresponding to a frame of the driving method of scan lines in the display panel according to one preferred embodiment of the present invention.

Two continuous frames displayed in a screen are illustrated. FIG. 4 is an illustrative view of a frame of the driving method of scan lines in the display panel according to one preferred embodiment of the present invention. FIG. 5 is an illustrative view of a voltage waveform corresponding to a frame of the driving method of scan lines in the display panel according to one preferred embodiment of the present invention.

As shown in FIG. 4, the screen displays a white block 401 within a grey level background. A data line 402 passes through the White block 401. One pixel unit a1 is a pixel above the white block 401 and another pixel unit a2 is a pixel under the white block 401.

As shown in FIG. 4 and FIG. 5, in one frame with a positive polarity, each pixel unit connected to the data line 402 is charged at the forward scan direction. When the pixel unit a1 is charged at the time t1, a TFT of the pixel unit a1 turns on so that the pixel unit a1 is charged by the data line 402 and a voltage of the pixel unit a1 keeps in a stable status after some time. Meanwhile, the pixel unit a2 maintains in a charging voltage of previous frame and has an inversion polarity corresponding to the pixel unit a1. The data line 402 becomes a higher voltage level at the time t2 and thus, the voltages of the pixel unit a1 and the pixel unit a2 shift toward a positive direction due to a leakage current effect of the TFT. Since the pixel unit a1 has a positive polarity voltage in a previous stage, the pixel unit a1 becomes brighter, and since the pixel unit a2 has a negative polarity voltage in a previous stage, the pixel unit a2 becomes darker. The pixel unit a2 is charged by the data line 402 at the time t3, and the voltage of the pixel unit a2 changes from a negative polarity to positive polarity at the time t3. During the time interval of t3 to t4, the pixel unit a1 and the pixel unit a2 are positive polarities. When the frame is displayed at the above forward scan direction, the crosstalk effect is that the pixel unit a1 becomes brighter and the pixel unit a2 becomes darker.

Afterwards, one frame with a negative polarity is charged. Specifically, each pixel unit connected to the data line 402 is charged at the backward scan direction.

During the time interval of t4 to t5, the pixel unit a1 and pixel unit a2 are maintained in a positive polarity of the previous frame. The pixel unit a2 is charged by the data line 402 at the time t5, and the voltage of the pixel unit a2 changes from a positive polarity to a negative polarity at the time t5. A voltage of the pixel unit a2 then keeps in a stable status after some time. Meanwhile, the pixel unit a1 maintains in a charging voltage of previous frame and has an inversion polarity corresponding to the pixel unit a2. The data line 402 becomes a higher voltage level at the time t6 and thus, the voltages of the pixel unit a1 and the pixel unit a2 shift toward an inverse direction due to a leakage current effect of the TFT. Since the pixel unit a1 has a positive polarity voltage in a previous stage, the pixel unit a1 becomes darker, and since the pixel unit a2 has a negative polarity voltage in a previous stage, the pixel unit a2 becomes brighter. When the frame is displayed at the above backward scan direction, the crosstalk effect is that the pixel unit a1 becomes darker and the pixel unit a2 becomes brighter.

The crosstalk effects corresponding to the forward scan direction and the backward scan direction respectively can be canceled and improved by using the forward scan direction and the backward scan direction to increase the display quality of the display panel.

Furthermore, when the refresh rate of the display panel is sixty frames per second, the sixty frames can be divided into two frame sets including first frame set and a second frame set to reallocate the sixty frames. In other words, the scan lines of each frame in the first frame set turn on by using the forward scan direction and the scan lines in the second frame set turn on by the backward scan direction so that the crosstalk effects on each frame of the first frame set and each frame of the second frame set can be canceled and improved to increase the display quality of the display panel.

In one preferred embodiment, the adjacent frames can be divided into different frame sets respectively.

In one preferred embodiment, the former thirty frames are defined as one frame set and the later thirty frames are defined as the other frame set so that the frames in the same frame set are continuous frames.

Based on the aforementioned descriptions, the number of the frames in the first frame set is equal to the number of the frames in the second frame set.

Furthermore, the number of the frames in the first frame set is unequal to the number of the frames in the second frame set due to the function of integrated circuits (ICs).

In one preferred embodiment of the present invention, a driving method of the scan lines in a display panel divides the adjacent frames into first frame set and a second frame set, where the scan lines of each frame in the first frame set turn on by using the forward scan direction and the scan lines in the second frame set turn on by the backward scan direction so that the crosstalk effects on each frame of the first frame set and each frame of the second frame set can be canceled and improved to increase the display quality of the display panel.

The present invention further provides a scan line driving device. A display panel includes a plurality of scan lines, a plurality of data lines, and a plurality of pixel units defined by the interlaced scan lines and data lines. The scan line driving device divides the adjacent frames into a first frame set and a second frame set, where the scan lines of each frame in the first frame set turn on by using the forward scan direction and the scan lines in the second frame set turn on by the backward scan direction.

The scan line driving device of the present invention is further configured to implement the driving method of the display panel and will not be repeated here.

In one preferred embodiment of the present invention, scan line driving device divides the adjacent frames into first frame set and a second frame set, where the scan lines of each frame in the first frame set turn on by using the forward scan direction and the scan lines in the second frame set turn on by the backward scan direction so that the crosstalk effects on each frame of the first frame set and each frame of the second frame set can be canceled and improved to increase the display quality of the display panel.

As is understood by a person skilled in the art, the foregoing preferred embodiments of the present invention are illustrative rather than limiting of the present invention. It is intended that they cover various modifications and similar arrangements be included within the spirit and scope of the present invention, the scope of which should be accorded the broadest interpretation so as to encompass all such modifications and similar structures.

What is claimed is:

1. A driving method of scan lines in a display panel, wherein the display panel comprises a plurality of scan lines, a plurality of data lines, and a plurality of pixel units defined by interlacing the scan lines with the data lines, the driving method comprising the steps of:

dividing a plurality of adjacent frames into a first frame set and a second frame set; and turning on the scan lines of each frame in the first frame set by using a forward scan direction and turning on the scan lines in the second frame set by a backward scan direction;

wherein a plurality of polarities corresponding to a plurality of pixel units in the adjacent frames are inversed, and the polarities corresponding to the pixel units in a same column are identical;

wherein the frames in a same frame set are a plurality of continuous frames, and a number of the frames in the first frame set is unequal to a number of the frames in the second frame set.

2. The driving method of scan lines in the display panel of claim 1, wherein the adjacent frames are divided into a plurality of different frame sets respectively.

3. The driving method of scan lines in the display panel of claim 1, wherein a number of the frames in the first frame set is equal to a number of the frames in the second frame set.

4. The driving method of scan lines in the display panel of claim 1, wherein the polarities corresponding to the pixel units in a plurality of adjacent columns are inversed.

5. A driving method of scan lines in a display panel, wherein the display panel comprises a plurality of scan lines, a plurality of data lines, and a plurality of pixel units defined by interlacing the scan lines with the data lines, the driving method comprising the steps of:

dividing a plurality of adjacent frames into a first frame set and a second frame set; and turning, by a forward scan direction, on the scan lines of each frame in the first frame set, and turning, by a backward scan direction, on the scan lines in the second frame set;

wherein the frames in a same frame set are a plurality of continuous frames, and a number of the frames in the first frame set is unequal to a number of the frames in the second frame set.

6. The driving method of scan lines in the display panel of claim 5, wherein the adjacent frames are divided into a plurality of different frame sets respectively.

7. The driving method of scan lines in the display panel of claim 5, wherein a number of the frames in the first frame set is equal to a number of the frames in the second frame set.

8. The driving method of scan lines in the display panel of claim 5, wherein a plurality of polarities corresponding to a plurality of pixel units in the adjacent frames are inversed.

9. The driving method of scan lines in the display panel of claim 5, wherein the polarities corresponding to the pixel units in a same column are identical.

10. The driving method of scan lines in the display panel of claim 9, wherein the polarities corresponding to the pixel units in a plurality of adjacent columns are inversed.

11. A scan line driving circuit in a display panel, wherein the display panel comprises a plurality of scan lines, a plurality of data lines, and a plurality of pixel units defined by interlacing the scan lines with the data lines, and wherein the scan line driving circuit is configured to divide a plurality of adjacent frames into a first frame set and a second frame set, and the scan line driving circuit is configured to turn on the scan lines of each frame in the first frame set by using a forward scan direction and to turn on the scan lines in the second frame set by a backward scan direction;

wherein the frames in a same frame set are a plurality of continuous frames, and a number of the frames in the first frame set is unequal to a number of the frames in the second frame set.

12. The scan line driving circuit in the display panel of claim 11, wherein a plurality of polarities corresponding to a plurality of pixel units in the adjacent frames are inversed.

13. The scan line driving circuit in the display panel of claim 11, wherein the adjacent frames are divided into a plurality of different frame sets respectively.

14. The scan line driving circuit in the display panel of claim 11, wherein a number of the frames in the first frame set is equal to a number of the frames in the second frame set.

* * * * *